US007899202B2

(12) United States Patent
Sumitani et al.

(10) Patent No.: US 7,899,202 B2
(45) Date of Patent: Mar. 1, 2011

(54) LOUDSPEAKER WITH CONE-COUPLED DAMPER

(75) Inventors: Yoichiro Sumitani, Rancho Palos Verdes, CA (US); Lin Chun-Yi, Xinzhuang (TW)

(73) Assignee: Sound Sources Technology, Inc., Torrance, CA (US)

( * ) Notice: Subject to any disclaimer, the term of this patent is extended or adjusted under 35 U.S.C. 154(b) by 1289 days.

(21) Appl. No.: 11/405,072

(22) Filed: Apr. 17, 2006

(65) Prior Publication Data

US 2007/0242850 A1 Oct. 18, 2007

(51) Int. Cl.
*H04R 25/00* (2006.01)

(52) U.S. Cl. ..... 381/398; 381/404; 381/412; 381/420; 381/423

(58) Field of Classification Search ..... 381/403, 381/404, 405, 412, 413, 420, 424, 396, 430, 381/431

See application file for complete search history.

(56) References Cited

U.S. PATENT DOCUMENTS 2,923,783 A * 2/1960 White ..... 381/422
2,974,204 A * 3/1961 Supitilov ..... 381/420
4,283,606 A 8/1981 Buck
4,619,342 A 10/1986 Buck
5,162,619 A 11/1992 Thiele et al.
5,909,014 A 6/1999 Mengel
6,236,733 B1 5/2001 Kato et al.
6,626,262 B1 9/2003 Chen
6,678,387 B2 * 1/2004 Kemmerer ..... 381/397
6,814,181 B2 11/2004 Abe et al.
6,865,282 B2 3/2005 Weisman

* cited by examiner

*Primary Examiner*—Suhan Ni
*Assistant Examiner*—Jasmine Pritchard
(74) *Attorney, Agent, or Firm*—Stetina Brunda Garred & Brucker

(57) ABSTRACT

A loudspeaker includes a circular damper, a cone, and a cylindrical bobbin. The circular damper may include a centrally disposed cone attachment protuberance and a peripherally disposed top plate attachment section. The cone may have a central inner portion that may be attached to the cone attachment protuberance of the damper. The cone may be attached to the cylindrical bobbin, which may have a voice coil coupled thereto.

13 Claims, 3 Drawing Sheets

LOUDSPEAKER WITH CONE-COUPLED DAMPER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field

The present invention generally relates to acoustical transducers and manufacturing methods thereof. More particularly, the present invention relates to damper and bobbin assemblies of loudspeakers.

2. Related Art

A loudspeaker is essentially a transducer for converting electrical energy to acoustic energy, and is universally known and utilized in audio systems. There are a wide variety of designs employing various operational principles, and can be generally categorized as electrodynamic, electrostatic, piezoelectric, or discharge speakers, among others. The most common type of loudspeaker is of the electrodynamic variety, in which an electrical signal representative of the desired audio is applied to a voice coil suspended between opposite poles of a magnet and attached to a semi-rigid cone. The voice coil interacts with the magnet by the generated electromagnetic force, and causes the coil and the semi-rigid cone to vibrate and reproduce the frequencies present in the electrical signal.

Conventional loudspeaker designs typically include a T-yoke, which defines an annular slot or air gap for receiving a bobbin having a voice coil. As will be readily recognized, the bobbin is a hollow cylindrical member configured to enable a sliding relation with the T-yoke, particularly within the annular slot. The T-yoke is typically cylindrical in shape and holds a magnet that is positioned in alignment with the voice coil on the bobbin. Placed above the magnet is a top plate, which connects the yoke and the magnet to a basket. The basket serves as an attachment and securing point for the surround, which is an annular flexible member that holds a cone-shaped diaphragm having a central opening. The bobbin is attached to the central opening of the diaphragm, and the opening of the bobbin is covered by a dust cap to reinforce the structural integrity of the diaphragm. Lateral and axial stability of the bobbin, and thus the diaphragm, is enhanced by a damper. The damper is typically a ring-shaped member having an interior edge glued to the bobbin and an exterior edge glued to the basket. In this regard, the damper resiliently supports the diaphragm and bobbin at the respective predetermined static positions within the air gap without contacting the surrounding surfaces of the yoke or the magnet.

One inherent deficiency in prior loudspeaker designs was that the power output of the loudspeaker was directly related to the number of turns in the voice coil, and consequently, the size of the voice coil was related to the size of the loudspeaker. Few alterations attempting to overcome these proportion-related deficiencies have been contemplated. In order to accommodate a greater number of turns, it was necessary for the height of the bobbin to be increased for a given width of the magnet and the yoke cooperating therewith. However, by increasing the height of the bobbin, the vertical position of the voice coil which is electromagnetically driven is deviated from the vertical position of the interior edge of the damper. This destabilized the bobbin and the diaphragm, resulting in what is referred to in the art as "rolling," thereby causing the voice coil to rub against the magnet or the yoke and resulting in distorted audio and damage to the voice coil. Therefore, under conventional loudspeaker designs, there was a ceiling of which no greater power output was possible without increases in size. Therefore, an alternative loudspeaker overcoming the aforementioned deficiencies would be desirable.

BRIEF SUMMARY

In accordance with the present invention, there is provided a loudspeaker which may include a circular damper which may define a first diameter. The damper may have a centrally disposed cone attachment protuberance and a peripherally disposed top plate attachment surface. Additionally, the loudspeaker may include a cone which may have a central inner portion and an outer portion. The central inner portion may be attached to the cone attachment protuberance of the damper. The loudspeaker may also include a cylindrical bobbin which has a second diameter, and attached to the cone. There may be a voice coil coupled to the cylindrical bobbin.

The second diameter of the bobbin may be greater than the first diameter of the damper. Effectively, the damper may be enclosed within the bobbin. The cone may be semi spherical and may define an interior convex surface and a corresponding exterior concave surface. In another embodiment, the cone attachment protuberance may include a concave surface corresponding to the shape of the cone, so that it may accommodate the interior convex surface thereof. As incident to the damper being enclosed within the bobbin, the bobbin may be attached to the outer portion of the cone.

The loudspeaker of the present invention may also include a yoke. The yoke may include a side wall member defined by an inner vertical surface and an outer vertical surface. The yoke may also include an annular base that defines a bottom base surface, a top base surface, and a first circular opening extending from the bottom base surface to the top base surface. The first opening may be centered on the annular base.

The loudspeaker may also include a basket that is coupled to the aforementioned yoke, as well as a surround that is attached to the basket and to the outer portion of the cone. There may also be an annular magnet disposed within the yoke. The annular magnet and the inner vertical surface of the yoke may define a section of an air gap. Additionally, a top plate may be disposed within the yoke. The yoke may define a damper attachment surface, an outer periphery, and a central opening. In one embodiment, the top plate may be attached to the annular magnet. The outer periphery of the top plate and the inner vertical surface of the yoke may define another section of the air gap, within which the voice coil may be positioned. Referring back to the damper, it may be attached to the damper attachment surface of the top plate.

The damper for an acoustic transducer may include a circular damper main body which defines a cone attachment protuberance. The circular damper main body may also define a peripheral corrugated section that has an inner portion which is contiguous with the cone attachment protuberance. Further, the circular damper main body may include an outer section that includes a top plate attachment surface. In another embodiment, the cone attachment protuberance may define a concave top surface. The circular damper main body may be defined by a top face and a bottom face, with the cone attachment protuberance projecting from the top face. On the other hand, the top plate attachment surface may be defined by the bottom face.

Further in accordance with the present invention, there is provided a method of constructing an acoustic transducer. One step may be constructing an upper assembly, including a bobbin having a voice coil, a cone, and a flexible annular surround. Another step may be constructing a transducer based including a magnet affixed to a yoke, and a top plate affixed to the magnet. This step may result in the magnet and the top plate being enclosed by the yoke and define an air gap therebetween. Next, the method may include attaching a basket to the transducer base, and affixing the upper transducer assembly to the basket such that the bobbin of the upper transducer assembly may be disposed within the air gap. The method may also include the step of removing the basket and the upper transducer assembly from the transducer base. The method may then be followed by the step of removing the basket and the upper transducer assembly from the transducer base. The method may further include the step of affixing a damper, which may have a main body defined by a central cone attachment protuberance and a peripheral corrugated section, to the top plate. The method of constructing the acoustic transducer may be concluded by affixing the basket and the upper transducer assembly to the transducer base. More particularly, the cone on the upper transducer assembly may be affixed to the central cone attachment protuberance on the damper.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, top and bottom, and the like are used solely to distinguish one from another entity without necessarily requiring or implying any actual such relationship or order between such entities.

Figure 1:
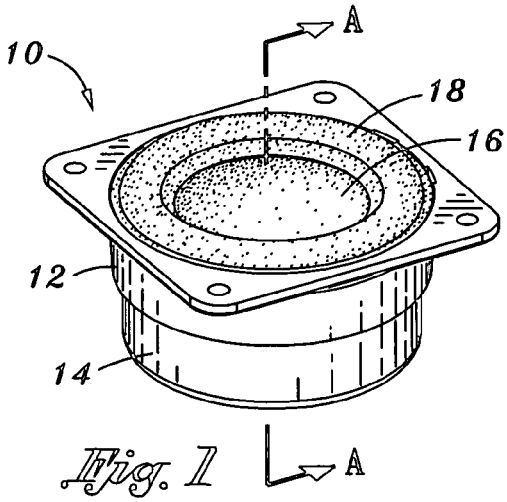
FIG. 1 is a perspective view of a loudspeaker constructed in accordance with the present invention.

Referring now to FIG. 1, a loudspeaker 10 constructed in accordance the present invention is illustrated. Loudspeaker 10 includes a basket 12, which is attached to a yoke 14. The yoke 14 is cylindrical, as is the portion of the basket 12 which attaches thereto. A flexible surround 18 is attached to the basket 12, which supports a cone 16.

Figure 2:
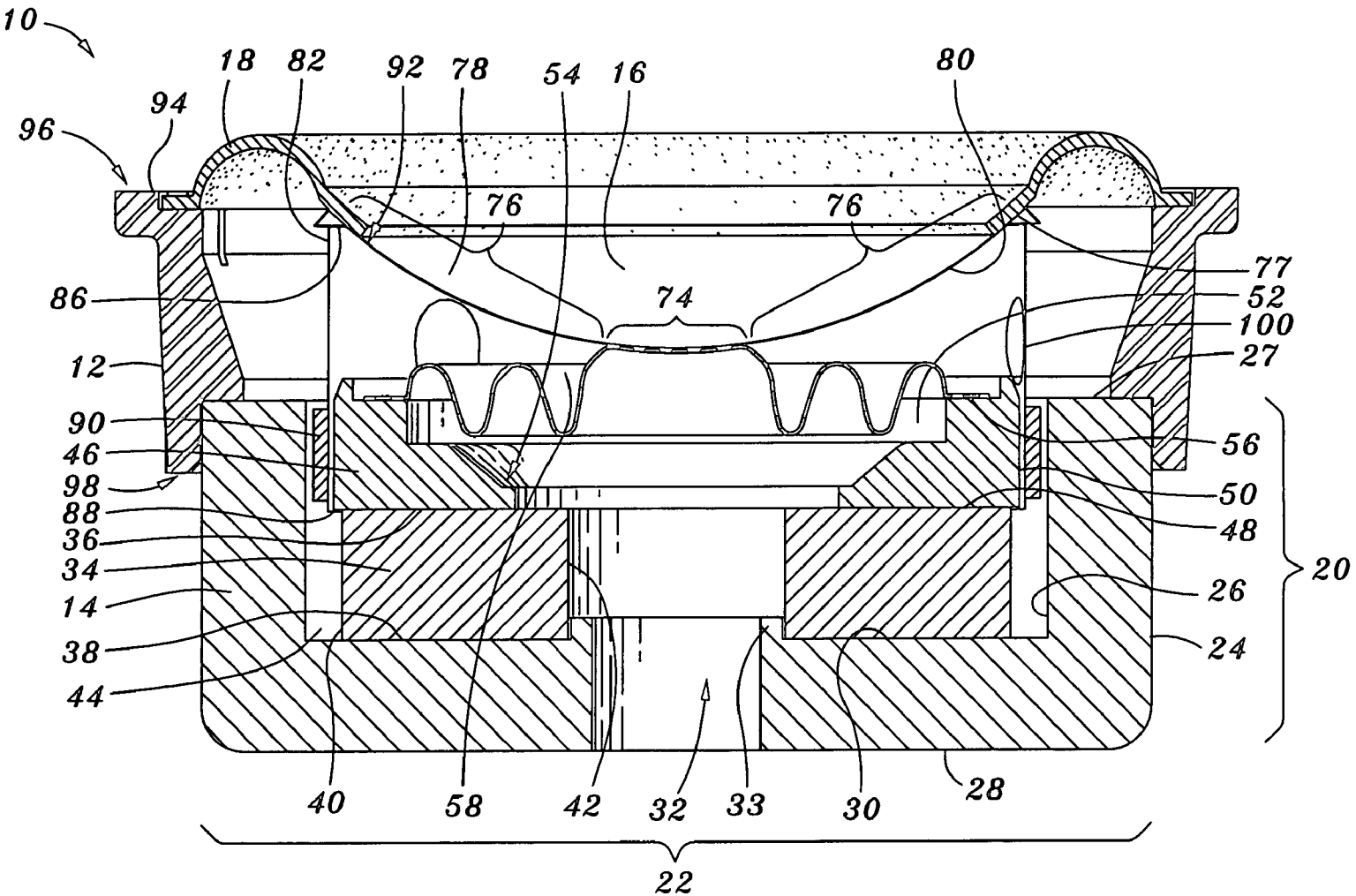
FIG. 2 is a cross-sectional view of the loudspeaker shown in FIG. 1.

In order to illustrate further details of the loudspeaker 10, reference may now be had to FIG. 2, which is a cross-sectional view of the loudspeaker 10 taken along axis A-A of FIG. 1. The yoke 14, as described above, is cylindrical in shape, and is defined by a cylinder wall portion 20 and an annular base portion 22. While being described in terms of these portions, a person having ordinary skill in the art will recognize that the cylinder wall portion 20 and the annular base portion 22 are typically of unitary construction. The cylinder wall portion 20 is defined by an outer wall surface 24, an opposed inner wall surface 26, and a top rim 27. The top rim 27 is perpendicular to the outer wall surface 24 and the inner wall surface 26. Further, the annular base portion 22 includes an outer base surface 28 and an inner base surface 30. The inner base surface 30 is typically perpendicular to the inner wall surface 26, as is the outer base surface 28 to the outer wall surface 24. Centrally disposed on the base 22 is a cylindrical port 32 that extends from the inner base surface 30 to the outer base surface 28. Projecting from the periphery of the port 32 is a notch 33.

Disposed within the interior of the yoke 14 is an annular magnet 34, which is defined by a top surface 36, an opposed bottom surface 38, an outer periphery 40 and an inner periphery 42. The annular magnet 34 is attached to the yoke 14, where the bottom surface 38 of the annular magnet 34 abuts the inner base surface 30 of the yoke 14. The inner periphery 42 of the annular magnet 34 defines a cylindrical opening therein, and frictionally engages the notch 33 of the yoke 14. In this manner, the annular magnet 34 is centrally attached to the yoke 14 such that the center axis of both the annular magnet 34 and the yoke 14 remain aligned. In addition, the outer periphery 40 of the annular magnet 34 and the inner wall surface 25 of the yoke 14 defines a section of an air gap 44.

Also disposed within the interior of the yoke 14 is a top plate 46, which is attached to the annular magnet 34. In this regard, the bottom surface 48 of the top plate 46 is in an abutting relationship with the top surface 36 of the annular magnet 34. The top plate 46 is defined by a top plate outer periphery 50, which is a cylindrical wall generally conforming to the shape of the inner wall surface 26 of the yoke 14. As illustrated in FIG. 2, the inner wall surface 26 of the yoke 14 and the top plate outer periphery 50 defines a section of the air gap 44. With respect to that section of the air gap 44 defined in part by the top plate outer periphery 50, it will be understood that the size thereof is typically smaller than that section of the air gap 44 defined in part by the annular magnet 34. In other words, the diameter of the top plate 46 is typically larger than the diameter of the magnet 34. However, such a configuration is presented by way of example only and not of limitation, and the diameter of the top plate 46 may be equal to the diameter of the magnet 34, in which the top plate outer periphery 50 is coplanar with the outer periphery 40 of the magnet 34.

As the top plate 46 is annular, a central opening 52 is defined by the same. Between the central opening 52 and the top plate outer periphery 50 is an inner region 54. While being illustrated as including various angles, sections, and the like in the figure, a person of ordinary skill in the art will recognize that the configuration of the inner region 54 may be of any shape. However, it is understood that the inner region 54 will include a flat arcuate damper attachment surface 56 encircling the central opening 52.

Figure 3:
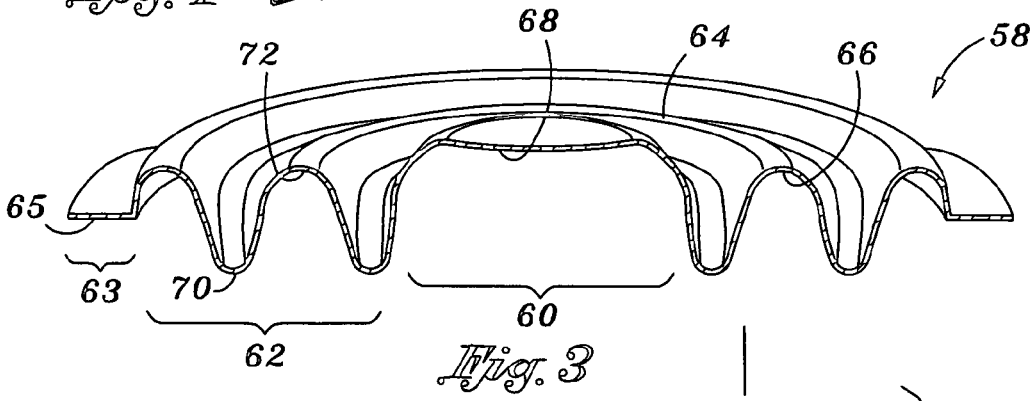
FIG. 3 is a cross-sectional view of a damper which may be incorporated in a loudspeaker constructed in accordance with the present invention.

With reference now to FIG. 3, a damper 58 for attachment to the top plate 46 on the damper attachment surface 56 is illustrated. As understood in the art, damper 58 may also be referred to as a spider. The damper 58 includes a centrally disposed cone attachment protuberance 60, a peripheral corrugated section 62 defining a series of concentric ridges 70 and peaks 72, and a top plate attachment section 63. As illustrated, the damper 58 is of a circular and a generally flat shape, and it follows that the cone attachment protuberance 60, the peripheral corrugated section 62, the top plate attachment section 63 are likewise circular. Specifically, the peripheral corrugated section 62 is annular, with the inner periphery of the annulus defined thereby adjacent to the outer periphery of the cone attachment protuberance 60. Additionally, the damper 58 defines a top face 64 and a bottom face 66. The cone attachment protuberance 60 protrudes upward from the top face 64, and includes a concave top surface 68, which is so configured to be adapted to the convex shape of the cone 16. The bottom face 66 of the damper 58, particularly that part which includes the top plate attachment section 63, defines a top plate attachment surface 65. Referring back to FIG. 1, the damper 58 is shown attached to the top plate 46. More particularly, the top plate attachment surface 65 on the damper 58 abuts the damper attachment surface 56 of the top plate 46.

The damper 58 is also directly attached to the cone 16, which is generally defined by a central inner portion 74, a surrounding outer portion 76, and an arcuate rim 77. The cone 16 also has an exterior, concave surface 78 and a corresponding interior convex surface 80. It will be understood that the central inner portion 74 refers to that area of the cone 16, particularly that of the interior convex surface 80 which contacts the cone attachment protuberance 60 of the damper 58. As discussed above, interior convex surface 80 of the cone 16 facilitates its attachment to the concave top surface 68 of the damper 58. A person of ordinary skill in the art will appreciate that while the cone 16 as illustrated in the figures is semi-spherical, a cone of any configuration may be readily substituted without departing from the scope of the present invention. It will further be understood that any variety of materials, including paper, metal, carbon fiber, and the like may be utilized for the construction of the cone 16.

At or in the vicinity of the rim 77 of the cone 16, a bobbin 82 and a surround 18 are attached thereto. More particularly, the bobbin 82 is attached to the interior convex surface 80 of the cone 16, while the surround 18 is attached the exterior concave surface 78 of the cone 16. It is understood that the attachment plane of the bobbin 82 to the cone 16 need not be the same as that of the surround 18. Additionally, it will be understood that neither the bobbin 82 nor the surround 18 are required to be attached exactly at the edge of rim 77, and any variation in the attachment of the bobbin 82 and surround 18 which enables the bobbin 82 to enclose the damper 58 is deemed to be within the scope of the invention.

The bobbin 82 is a hollow cylindrical member having a top end 86 and a lower end 88. Disposed at the lower end 88 is a voice coil 90, which is a strand of wire, wrapped around the bobbin 82 such that the coil resulting therefrom is coaxial with the bobbin 82 and the annular magnet 34. The voice coil 90 and the bobbin 82 are sized to fit within the confines of the air gap 44 and to freely move therein without contacting the top plate 46, the annular magnet 34, or the yoke 14. Typically, the bobbin 82 is constructed of paper fiber, but may be constructed of any suitably lightweight and rigid material such as aluminum. Additionally, as will be readily understood, the wire used to form the voice coil 90 is typically copper, and may be electrically connected to terminals (not shown) that may be attached to the basket 12 or other location deemed appropriate by one of ordinary skill in the art.

With regard to the annular surround 18, the inner periphery 92 thereof is attached to the vicinity of the rim 77 of the cone 16, while the outer periphery 94 thereof is attached to the basket 12. The basket 12 has an upper rim 96, to which the outer periphery 94 of the cone 16 is attached, and a lower rim 98, which attaches to the top rim 27 of the yoke 14. The annular surround 18 has appropriate compliance and stiffness, and supports the cone 16, the bobbin 82, and the voice coil 90 wound thereto.

As is well understood by those having ordinary skill in the art, and as hereinbefore described, sound is reproduced by the loudspeaker 10 by the vibration of the cone 16. An electrical signal is applied to the voice coil 90, inducing a magnetic field concentrated in the air gap 44. The voice coil 90 interacts with the annular magnet 34, thereby moving the bobbin 82 a proportional distance to the electrical signal applied. As described above and as illustrated in the figures, the bobbin 82 is attached to the cone 16, resulting in the cone 16 being vibrated according to the movement of the bobbin 82. As the bobbin 82 moves within the air gap 44, it is supported by the surround 18, serving to reduce the lateral movement, or rolling, of the bobbin 82. Furthermore, the damper 58 likewise flexibly supports the bobbin 82, indirectly via the cone 16. The corrugations defining the peaks 72 and the ridges 70 on the damper 58 resiliently support the cone 16 and permit the same to vibrate. However, because of its slight rigidity, excessive vibration of high amplitude is reduced, as are the effects of rolling. By constructing the loudspeaker 10 such that the bobbin 82 encloses the top plate 46 and the damper 58, with the damper 58 being attached to the cone 16, lateral stability of the bobbin 82 is maximized due to the increased diameter thereof and the damper 58. Further, the larger bobbin 82 permits greater turns in the voice coil 90, enhancing the power output of the loudspeaker 10.

Figure 6:
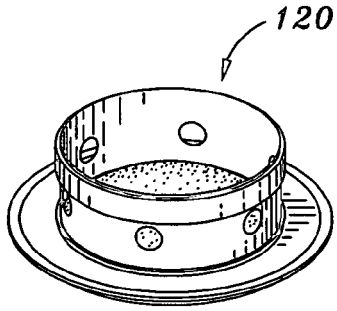
FIG. 6 is a perspective view of a completed upper assembly as shown in FIG. 5.
Figure 5:
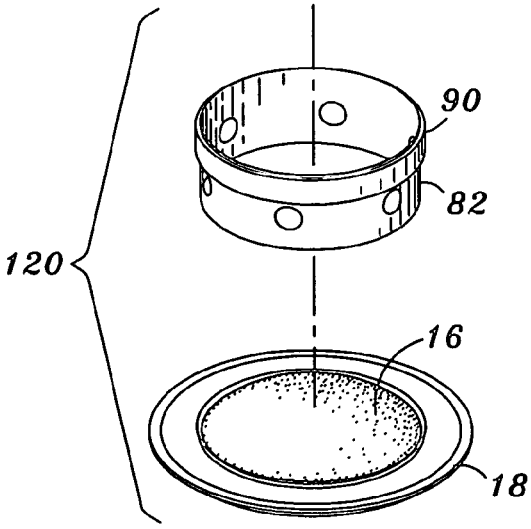
FIG. 5 is a perspective view of an upper assembly of the loudspeaker of the present invention with its constituent parts separated, including a bobbin, a voice coil, a cone, and a surround.
Figure 7:
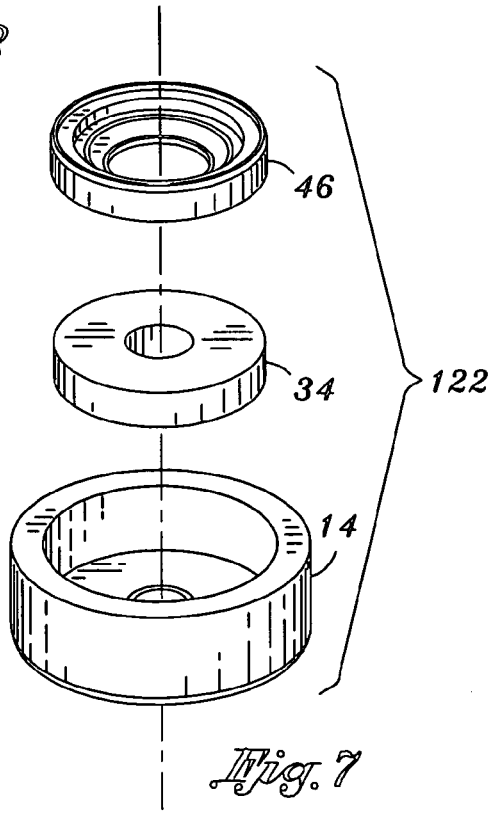
FIG. 7 is a perspective view of a base of the loudspeaker of the present invention with its constituent parts separated, including a yoke, a magnet, and a top plate.
Figure 4:
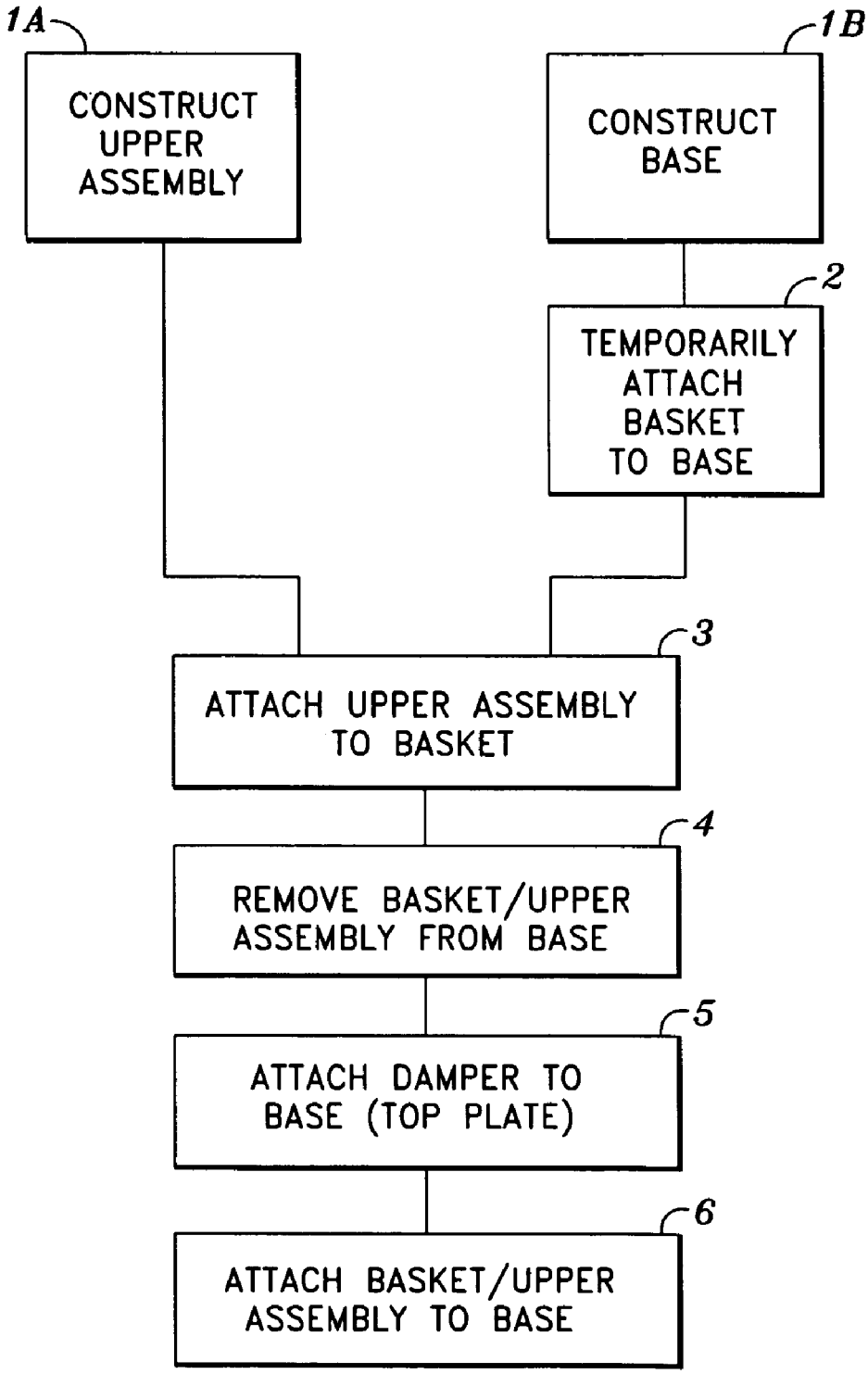
FIG. 4 is a flowchart illustrating the steps necessary to assemble a loudspeaker in accordance with the present invention.

Turning now to the flowchart of FIG. 4, the steps for constructing the loudspeaker 10 in accordance with an aspect of the present invention will now be described. As per step 1*a*, now referring additionally to FIGS. 5 and 6, an upper assembly 120 is constructed. The upper assembly 120 includes the bobbin 82 with the voice coil 90 wound thereon, and the cone 16 attached to the surround 18. The bobbin 82 is glued or otherwise affixed to the cone 16. Concurrently, according to step 1*b*, a base 122 is constructed as illustrated in FIG. 7. The base 122 includes the yoke 14, the annular magnet 34, and the top plate 46. As described above, the notch 33 on the yoke 14 aids in the alignment of the annular magnet 34 within the yoke 14. Prior to the insertion of the annular magnet 34 within the yoke 14, glue or other adhesive is applied thereon. Thereafter, the top plate 46 is glued to the magnet 34, resulting in the base 122.

Next, according to step 2, the basket 12 is temporarily attached to the base 122, and according to step 3, the upper assembly 120 is attached to the basket. More particularly, the surround 18 is glued to the basket 12. In this way, prior to finalizing the assembly, proper fitting of the bobbin 82 and the individual components of the base 122 may be verified, ensuring that the voice coil 90 does not rub against either the annular magnet 34, the top plate 46, or the yoke 14.

As indicated in step 4, the combined basket 12 and upper assembly 120 is removed from the base 122, and separated. Upon separation, as per step 5, the damper 58 is glued to the base 122, specifically to the top plate 46. According to step 6, after drying the glue applied in step 5, the upper assembly 120 and the now attached basket 12 is glued to the base 122. Specifically, the basket 12 is glued to the yoke 14, and the cone 16 is glued to the damper 58, completing the assembly of loudspeaker 10.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. An acoustic transducer, comprising:

a circular damper having a first diameter, the damper being defined by an axially centered cone attachment protuberance and a peripheral top plate attachment surface;

a cone having a central inner portion, a central axis, and an outer portion, the central inner portion of the cone being attached to the cone attachment protuberance of the circular damper in a coaxial relationship; and a cylindrical bobbin having a second diameter attached to the cone, the cylindrical bobbin being coupled to a voice coil;

wherein the second diameter of the bobbin is greater than the first diameter of the damper.

2. The transducer of claim 1 wherein the cone is semi spherical and defines an interior convex surface and a corresponding exterior concave surface.

3. The transducer of claim 1 wherein the cone attachment protuberance includes a concave surface corresponding to the shape of the cone.

4. The transducer of claim 1 wherein the bobbin is attached to the outer portion of the cone.

5. The transducer of claim 1, further comprising:

a yoke including a side wall member defined by an inner vertical surface and an outer vertical surface.

6. The transducer of claim 5 wherein the yoke further includes an annular base defining a bottom base surface, a top base surface, and a first circular opening extending from the bottom base surface to the top base surface, the first opening being centered on the annular base.

7. The transducer of claim 6, further comprising:

a basket coupled to the yoke; and a surround attached to the basket and to the outer portion of the cone.

8. The transducer of claim 7, further comprising:

an annular magnet disposed within the yoke, the annular magnet and the inner vertical surface of the yoke defining a section of an air gap, within which the voice coil is positioned.

9. The transducer of claim 8, further comprising:

a top plate disposed with the yoke, the top plate defining a damper attachment surface, an outer periphery, and a central opening.

10. The transducer of claim 9 wherein the top plate is attached to the annular magnet.

11. The transducer of claim 10 wherein the damper is attached to the damper attachment surface of the top plate.

12. The transducer of claim 11 wherein the outer periphery of the top plate and the inner vertical surface of the yoke defines a section of the air gap.

13. An acoustic transducer, comprising:

a circular damper defining a first diameter, the damper having a centrally disposed cone attachment protuberance and a peripherally disposed top plate attachment surface;

a cone having a central inner portion and an outer portion, the central inner portion of the cone being attached to the cone attachment protuberance of the circular damper;

a cylindrical bobbin having a second diameter attached to the cone, the cylindrical bobbin being coupled to a voice coil;

a yoke including a side wall member defined by an inner vertical surface and an outer vertical surface, an annular base defining a bottom base surface, a top base surface, and a first circular opening extending from the bottom base surface to the top base surface, the first opening being centered on the annular base;

a basket coupled to the yoke;

a surround attached to the basket and to the outer portion of the cone;

an annular magnet disposed within the yoke, the annular magnet and the inner vertical surface of the yoke defining a section of an air gap; and a top plate disposed with the yoke and attached to the annular magnet, the top plate defining a damper attachment surface to which the damper is attached, an outer periphery, and a central opening, the outer periphery of the top plate and the inner vertical surface of the yoke defining a section of the air gap within which the voice coil is positioned.

* * * * *